US005890119A

United States Patent [19]

Suzuki

[11] Patent Number: 5,890,119

[45] Date of Patent: Mar. 30, 1999

[54] DIGITAL SOUND GENERATING SYSTEM PERMITTING A SHARED USE OF A HARDWARE RESOURCE BETWEEN DIFFERENT TYPE TONE GENERATORS

[75] Inventor: Norio Suzuki, Hamamatsu, Japan

[73] Assignee: Yamaha Corporation, Hamamatsu, Japan

[21] Appl. No.: 784,798

[22] Filed: Jan. 16, 1997

[30] Foreign Application Priority Data

Jan. 17, 1996 [JP] Japan ..... 8-006192

[51] Int. Cl.[6] ..... G10L 9/18; G10H 7/00

[52] U.S. Cl. ..... 704/267; 84/603; 84/604

[58] Field of Search ..... 704/267; 84/603, 84/604, 605

[56] References Cited

U.S. PATENT DOCUMENTS

| | | | |
|---|---|---|---|
| 5,087,043 | 2/1992 | Billings et al. | 273/157 R |
| 5,121,668 | 6/1992 | Zegan et al. | 84/646 |
| 5,209,665 | 5/1993 | Billings et al. | 434/169 |
| 5,247,130 | 9/1993 | Suzuki | 84/622 |
| 5,389,729 | 2/1995 | Hiramatsu | 84/601 |
| 5,430,242 | 7/1995 | Morita | 84/609 |

*Primary Examiner*—David R. Hudspeth
*Assistant Examiner*—Tálivaldis Ivars Šmits
*Attorney, Agent, or Firm*—Graham & James LLP

[57] ABSTRACT

A digital sound generating system is provided which is capable of, in addition to generating a tone (first waveform data), recording or reproducing PCM sound data representing a human voice or sound of a music piece lasting for a relatively long time (second waveform data). To this end, in the tone generating process, tone waveform sample data is read out from a waveform RAM on the basis of address data given from an address calculating section and is then output as an analog signal via an interpolating section and D/A converter. In reproduction of PCM sound data, the PCM sound data supplied via a CPU interface is transferred using the waveform RAM as a buffer and is then supplied outside of the system through a same channel as in the tone generating process. In recording of PCM sound data, a high-frequency-component removing process is performed, by a filtering calculating section, on PCM sound data received via an A/D converter so as to prevent unwanted aliasing noise. The resultant filtered PCM sound data is then transferred using the waveform RAM as a buffer and output via the CPU interface.

27 Claims, 5 Drawing Sheets

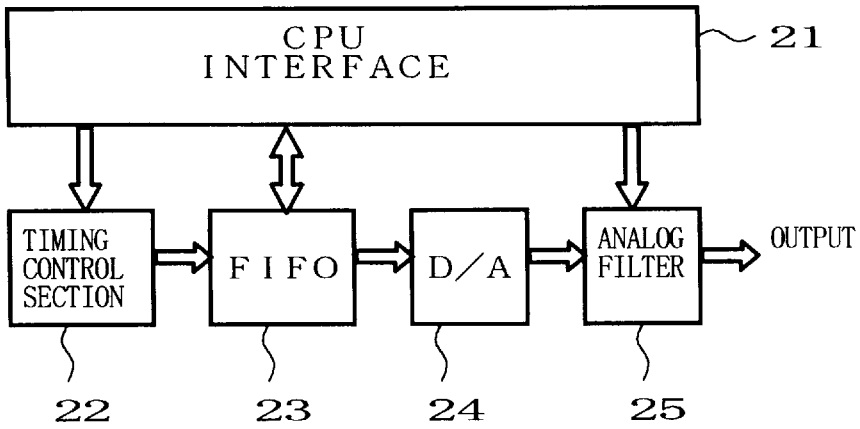
(PRIOR ART) FIG. 5
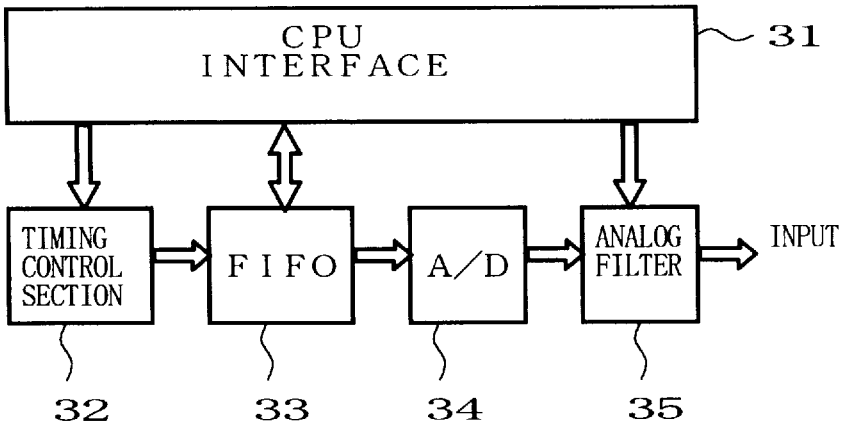
(PRIOR ART) FIG. 6

DIGITAL SOUND GENERATING SYSTEM PERMITTING A SHARED USE OF A HARDWARE RESOURCE BETWEEN DIFFERENT TYPE TONE GENERATORS

BACKGROUND OF THE INVENTION

The present invention relates to a digital sound generating system which is capable of, in addition to forming a tone waveform (first waveform data), reproducing or recording a waveform of a human voice or sound of music lasting for a relatively long time (second waveform data).

Today, in many fields, efforts are being made to enjoy the benefits of the so-called "multimedia" for enriching types of information to be provided to users and forms of receiving and transmitting information to users. Various types of equipment, such as personal computers, incorporating therein a PCM tone generator were provided in the past, but in recent years, equipment provided with functions to reproduce or record human voices or sounds of an actually performed music piece sampled from the outside (hereinafter called "vocal sounds or the like" or "second waveform") as well as electronic sounds (hereinafter called "tones" or "first waveform") have been developed. Because vocal sounds or the like have generally much longer duration than tones, personal computers and similar equipment have been developed which contain dedicated hardware, such as a PCM sound reproducing and/or recording device, for reproduction and/or recording of such vocal sounds or the like.

FIG. 5 is a block diagram showing an exemplary structure of a conventionally-known PCM sound reproducing device, which comprises a CPU interface 21, a timing control section 22, a FIFO memory 23, a digital-to-analog (D/A) converter 24 and an analog filter 25. The PCM sound reproducing device is incorporated in a personal computer or other system having a large-capacity storage device such as a hard disk device (not shown). In the large-capacity storage device of the system, there are prestored PCM sound data made by sampling and coding a continuous waveform, as of a human voice (vocal sound), having relatively long duration or sounding time. In reproduction of the vocal sound, the PCM sound data are read out from the large-capacity storage device and transferred to the PCM sound reproducing device under the control of a CPU (not shown).

The CPU interface 21 is a means for receiving and delivering information between the system's CPU and the PCM sound reproducing device, and the PCM sound data are introduced via this interface 21 into the PCM sound reproducing device and accumulated in the FIFO memory 23.

The timing control section 22 controls respective operational timing of the various components of the PCM sound reproducing device. In reproducing the vocal sound, the timing control section 22 sets a sampling frequency at which the PCM sound data are to be reproduced (reproduction sampling frequency) in accordance with instructions given from the CPU, and generates sampling clock pulses at the thus-set reproduction sampling frequency. In response to the sampling clock pulses, the PCM sound data are sequentially retrieved, one by one, from the FIFO memory 23 and converted by the D/A converter 24 into analog representation.

In normal cases, the reproduction sampling frequency of the PCM sound data is set to be substantially lower than the double of the highest audio frequency, so that the analog signals output from the D/A converter 24 will contain aliasing noise. For this reason, a high-performance analog filter 25 having a sharp cut-off characteristic is provided at a stage following the D/A converter 24, and each analog signal output from the D/A converter 24 is passed through this filter 25 so that the analog signal without aliasing noise is supplied to a sound output device such as a speaker. To effectively remove the aliasing noise, it is preferred that the analog filter 25 of a considerably large scale be used. In many cases, a switched capacitor filter is used as the analog filter 25.

Once the number of the PCM sound data in the FIFO memory 23 has been reduced to a predetermined value by the sound data being sequentially retrieved from the memory 23, the timing control section 22 sends, via the CPU interface 21, a request to the CPU to further supply succeeding PCM sound data. In response to the request, the succeeding PCM sound data are sequentially read out from the large-capacity storage device and introduced into the reproducing device via the CPU interface 21. The introduced PCM sound data are sequentially accumulated in the FIFO memory 23 under the control of the timing control section 22.

The thus-accumulated PCM sound data are then sequentially reproduced at a predetermined rate, during which time further succeeding PCM data are supplied to the FIFO memory 23, so as to reproduce the continuous waveform of the vocal sound lasting for a long time.

FIG. 6 is a block diagram showing an exemplary structure of a conventionally-known PCM sound recording device, which comprises a CPU interface 31, a timing control section 32, a FIFO memory 33, an analog-to-digital (A/D) converter 34 and an analog filter 35. As in the above-mentioned PCM sound reproducing device, the PCM sound recording device is incorporated in a personal computer or other system having a large-capacity storage device such as a hard disk device (not shown).

The timing control section 32, prior to recording a vocal sound, sets a sampling frequency at which a continuous waveform of the vocal sound is to be sampled (recording sampling frequency) in accordance with instructions given from the CPU, and generates sampling clock pulses at the thus-set recording sampling frequency. Each analog signal representing the waveform is passed through the analog filter 35 so that high-frequency components are removed from the signal via the filter 35, and then the analog signal is supplied to the A/D converter 34. In the A/D converter 34, the analog signal is sampled in accordance with the sampling clock pulse and converted into PCM sound data.

In the known PCM sound recording device, the analog filter 35 eliminates the high-frequency components from the analog signal in advance in such a manner that the PCM sound data from the A/D converter 34 does not contain unwanted aliasing noise. For this reason, the analog filter 35 needs to be a high-performance filter having a sharp cut-off characteristic, as in the above-mentioned PCM sound reproducing device. Further, because the recording sampling frequency of the A/D converter 34 is optionally changed in this recording device, the analog filter 35 is of a type whose cut-off frequency is adjustable depending on a change in the recording sampling frequency.

Each PCM sound data output from the A/D converter 34 is accumulated in the FIFO memory 33. Once a predetermined quantity of the PCM sound data have been accumulated in the FIFO memory 33, the timing control section 32 sends, via the CPU interface 31, a request to the CPU to store the accumulated PCM sound data. When the CPU accepts the request, the PCM sound data accumulated in the FIFO memory are read out under the control of the timing control section 32 and output via the CPU interface 31 to the large-capacity storage device for storage therein.

In the above-mentioned manner, analog signals of vocal sounds or the like are converted into PCM sound data and accumulated in the FIFO memory 33, and each time the predetermined quantity of the PCM sound data have been accumulated, they are read out from the FIFO memory 33 and stored into the large-capacity storage device.

However, in the known personal computer or other system, it was necessary that the PCM sound reproducing or recording device be provided separately from a tone generator, in order to reproduce or record a long-lasting continuous waveform of a vocal sound or the like in addition to generating a tone. Further, the PCM sound reproducing or recording device required a high-performance analog filter in order to obviate aliasing noise, and in cases where the reproduction or recording sampling frequency was to be changed, the analog filter itself had to be of large scale because it was necessary to change the characteristic of the analog filter. As a result, the known system required high overall costs.

SUMMARY OF THE INVENTION

It is therefore an object of the present invention to provide a digital sound generating system which is capable of, in addition to generating a tone signal (first waveform data), reproducing or recording a waveform of a human voice, sound of a music piece or the like lasting for a relatively long time (second waveform data), by a shared use of same tone generator circuitry.

Namely, the object of the present invention is to provide a digital sound generating system of a dual-tone-generator type which allow same hardware resources, such as a digital filter circuit and digital-to-analog converter circuit, to be shared between the two different tone generators.

In order to accomplish the above-mentioned object, the present invention provides a digital sound generating system which comprises: a storage section including first and second storage areas for storing waveform data, at least the second storage area comprising a readable and writable memory; an addressing section for making address data for writing or reading out waveform data into or from the storage section; a digital filter section for filtering the waveform data read out from the storage section; a first control section for controlling the addressing section to read out first waveform data stored in the first storage area at a rate corresponding to a desired tone pitch, so as to permit reproduction of a sound corresponding to the first waveform data; a supply section for supplying second waveform data; and a second control section for controlling the addressing section to write specific ones of the second waveform data from the supply section into the second storage area and then sequentially read out the specific ones of the second waveform data from the second storage area, the second control section also controlling the addressing section to write other ones of the second waveform data into the second storage area where the specific ones of the second waveform data have been read out and then sequentially read out the other ones of the second waveform data, so as to allow sounds corresponding to the second waveform data to be reproduced in a successive manner.

The first-type tone generator generates a desired sound by reading out first waveform data from the first storage area, while the second-type tone generator generates a desired sound on the basis of second waveform data supplied from outside of the system. The second-type tone generator writes specific ones of the second waveform data into the second storage area and then sequentially reads out the specific ones of the second waveform data from the second storage area, and subsequently writes other ones of the second waveform data into the second storage area from which the specific ones of the second waveform data have been read out and then sequentially read out the other ones of the second waveform data. Therefore, the second waveform data may be suitably obtained from any optional continuous sound sampled from outside of the system, such as a vocal sound of a human being or a sound of a music piece that involves a relatively long reproduction or sounding time. On the other hand, the first waveform sample data may be suitably obtained from a sound or tone normally created by an electronic musical instrument. With such an arrangement, digital sounds from the two different-type tone generators can be reproduced via a shared use of the same hardware resources.

The digital sound generating system may further comprise an interpolating section for interpolating between the waveform data read out from the storage section, so that output data from the interpolating section are supplied to the digital filter section. This arrangement allows the same waveform data interpolating section to be shared between the two different-type tone generators.

The present invention also provides a digital sound generating system which comprises a storage section including first and second storage areas for storing waveform data, at least the second storage area comprising a readable and writable memory; an addressing section for making address data for writing or reading out waveform data into or from the storage section; a digital filter section; a first control section for controlling the addressing section to read out first waveform data stored in the first storage area at a rate corresponding to a desired tone pitch and supplying the read-out first waveform data to the digital filter section, so as to allow reproduction of a sound corresponding to the first waveform data; an analog-to-digital converter section for converting into digital data an analog sound signal sampled from outside of the system and supplying the digital data to the digital filter section; and a second control section for controlling the addressing section to sequentially write the digital data from the digital filter section into the second storage area for temporary storage therein and then sequentially read out the digital data from the second storage area, the second control section outputting the digital data, read out from the second storage area, from the system.

With this arrangement, the digital filter section normally used for reproduction of the first waveform data can be also used to filter a sound signal sampled from the outside.

The present invention also provides a digital sound generating system which comprises a storage section including first and second storage areas for storing waveform data, at least the second storage area comprising a readable and writable memory; an addressing section for making address data for writing or reading out waveform data into or from the storage section; a digital filter section; a first control section for controlling the addressing section to read out first waveform data stored in the first storage area at a rate corresponding to a desired tone pitch and supplying the read-out first waveform data to the digital filter section, so as to allow reproduction of a sound corresponding to the first waveform data; a supply section for supplying second waveform data; a second control section for controlling the addressing section to write specific ones of the second waveform data from the supply section into the second storage area and then sequentially read out the specific ones of the second waveform data from the second storage area, the second control section also controlling the addressing section to write other ones of the second waveform data into the second storage area where the specific ones of the second waveform data have been read out and then sequentially read out the other ones of the second waveform data, so as to allow sounds corresponding to the second waveform data to be reproduced in a successive manner; an analog-to-digital converter section for converting into digital data an analog sound signal sampled from outside of the system and supplying the digital data to the digital filter section; and a third control section for controlling the addressing section to sequentially write the digital data from the digital filter section into the second storage area for temporary storage therein and then sequentially read out the data from the second storage area, the third control section outputting the digital data, read out from the second storage area, from the system.

With this arrangement, digital sounds from the two different-type tone generators can be reproduced via a shared use of the same hardware resources, and the digital filter section normally used for reproduction of the waveform data can be also used to filter a sound signal sampled from the outside.

The present invention also provides a digital sound generating system for outputting an analog signal representing a tone waveform and an analog signal representing a continuous waveform having a long reproduction time, which comprises: a memory; an address calculating section that is responsive to a tone generating instruction for sequentially outputting tone waveform address data changing at a rate corresponding to a frequency of a tone waveform to be formed and is also responsive to a continuous waveform reproducing instruction for sequentially outputting continuous waveform address data changing at a rate corresponding to a sampling frequency of a continuous waveform to be reproduced; an interpolating section for, when the tone generating instruction is given and tone waveform sample data are read out from the memory, performing an interpolation process on a predetermined number of read-out tone waveform sample data so as to output tone waveform resample data corresponding to the tone waveform address data, and when the continuous waveform reproducing instruction is given and continuous waveform sample data are read out from the memory, performing an interpolation process on a predetermined number of read-out continuous waveform sample data so as to output continuous waveform resample data corresponding to the continuous waveform address data; a memory access control section for, when the tone generating instruction is given, storing into the memory tone waveform sample data representing a tone waveform to be formed and sequentially reading out the tone waveform sample data from the memory on the basis of the tone waveform address data, and when the continuous waveform reproducing instruction is given, loading continuous waveform sample data representing a continuous waveform from outside into the system so as to store the continuous waveform sample data into the memory depending on a state of vacancy in the memory and then sequentially reading out the continuous waveform sample data from the memory on the basis of the continuous waveform address data; a filtering calculating section for, using an adjustable filter coefficient, performing a tone-color adjusting filtering process on the tone waveform resample data and performing a high-frequency-component removing process on the continuous waveform address data to prevent aliasing noise; and a digital-to-analog converter for converting, into an analog signal, the tone waveform resample data or continuous waveform resample data having undergone the filtering process.

The present invention also provides a digital sound generating system for outputting an analog signal representing a tone waveform and an analog signal representing a continuous waveform involving a relatively long reproduction time, which comprises: a memory; an analog-to-digital converter for, in response to a sampling clock pulse of fixed frequency, sampling and coding the analog signal representing a continuous waveform so as to output continuous waveform sample data; an address calculating section that is responsive to a tone generating instruction for sequentially outputting tone waveform address data changing at a rate corresponding to a frequency of a tone waveform to be formed and is also responsive to a continuous waveform reproducing or recording instruction for sequentially outputting continuous waveform address data changing at a rate corresponding to a sampling frequency of a continuous waveform to be reproduced or recorded; an interpolating section for, when the tone generating instruction is given and tone waveform sample data are read out from the memory, performing an interpolation process on a predetermined number of read-out tone waveform sample data so as to output tone waveform resample data corresponding to the tone waveform address data, and when the continuous waveform reproducing or recording instruction is given and continuous waveform sample data are read out from the memory, performing an interpolation process on a predetermined number of read-out continuous waveform sample data so as to output continuous waveform resample data corresponding to the continuous waveform address data; a memory access control section for operating in such a manner that: when the tone generating instruction is given, the memory access control section stores into the memory tone waveform sample data representing a tone waveform to be formed and sequentially reads out the tone waveform sample data from the memory on the basis of the tone waveform address data; when the continuous waveform reproducing instruction is given, the memory access control section loads continuous waveform sample data representing a continuous waveform from outside into the system so as to store the continuous waveform sample data into the memory depending on a state of vacancy in the memory and then sequentially reads out the continuous waveform sample data from the memory on the basis of the continuous waveform address data; and when the continuous waveform recording instruction is given, the memory access control section stores into the memory the continuous waveform sample data supplied via the analog-to-digital converter and reads out the continuous waveform sample data from the memory on the basis of the continuous waveform address data to supply the read-out continuous waveform sample data to the interpolating section, the memory access control section also storing into the memory the continuous waveform resample data output from the interpolating section and outputting the continuous waveform resample data from the system each time a predetermined quantity of the continuous waveform resample data have been accumulated in the memory; a filtering calculating section for, using an adjustable filter coefficient, performing a tone-color adjusting filtering process on the tone waveform resample data, and performing a high-frequency-component removing process on the continuous waveform resample data supplied from the interpolating section and the continuous waveform sample data supplied from the analog-to-digital converter to the memory access section so as to prevent aliasing noise therefrom; and a digital-to-analog converter for converting, into an analog signal, the tone waveform resample data or continuous waveform resample data having undergone the process by the filtering calculating section.

BRIEF DESCRIPTION OF THE DRAWINGS

For better understanding of the present invention, the preferred embodiments of the invention will be described in detail below with reference to the accompanying drawings, in which:

FIG. 5 is a block diagram showing an exemplary structure of a conventionally-known PCM sound reproducing device; and FIG. 6 is a block diagram showing an exemplary structure of a conventionally-known PCM sound recording device.

DETAILED DESCRIPTION OF THE PREFERRED EMBODIMENTS

Figure 1:
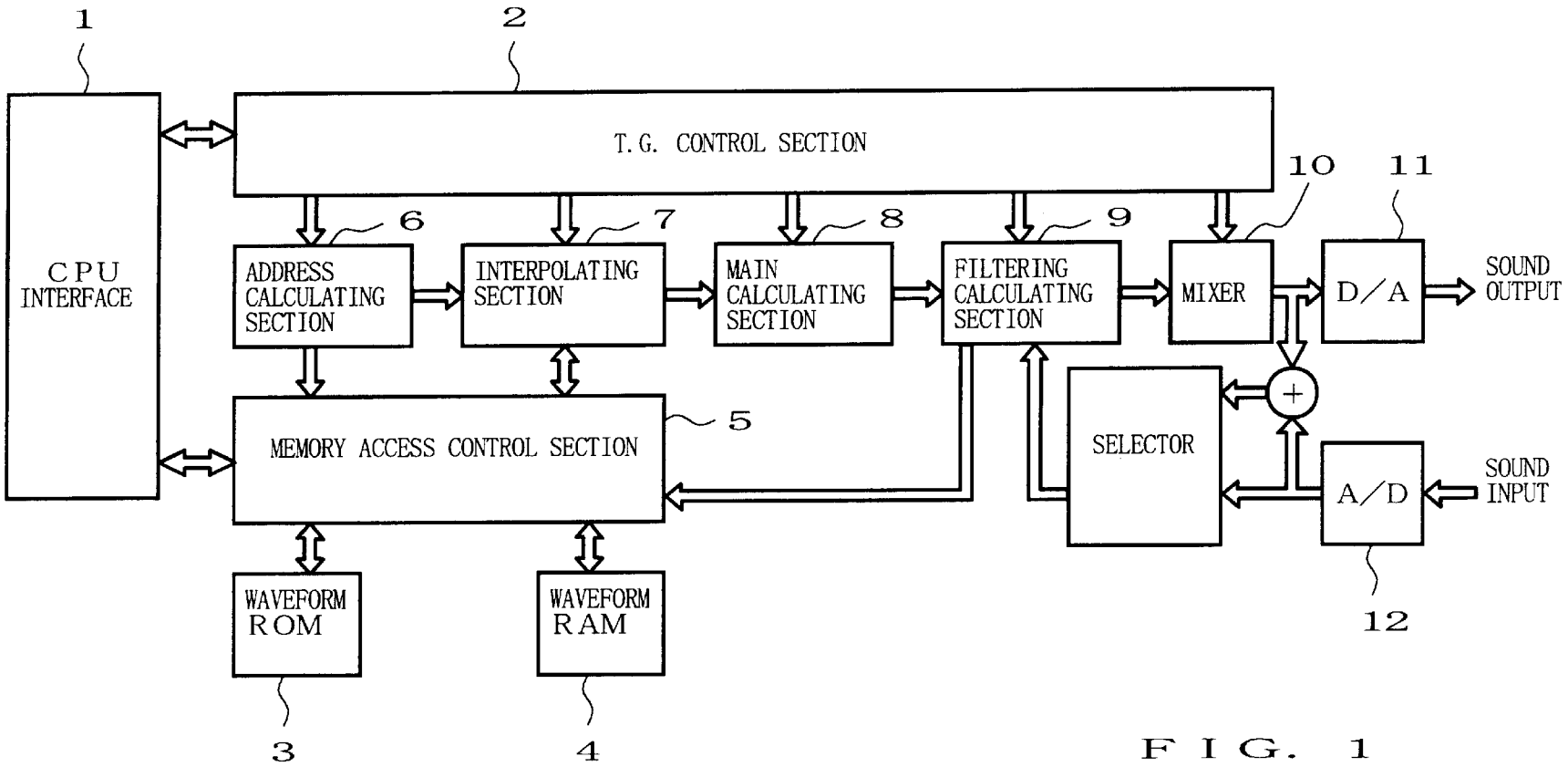
FIG. 1 is a block diagram illustrating an overall structure of a digital sound generating system according to an embodiment of the present invention.

FIG. 1 is a block diagram illustrating an overall structure of a digital sound generating system according to an embodiment of the present invention. This digital sound generating system is incorporated in a personal computer or other system that includes a large-capacity storage device such as a hard disk device, and it is designed to perform processing to record and reproduce PCM sound data (continuous waveform sample data) in addition to forming tone waveform.

In the embodiment of FIG. 1, a CPU interface 1 is provided for receiving and delivering information from and to a CPU (not shown) of the system. A tone generator control section 2 controls various components provided in the digital sound generating system. A tone waveform ROM 3 has sample data of various tone waveforms (tone waveform sample data) prestored therein. The digital sound generating system also includes a waveform RAM 4. While waveform RAMs in conventional PCM tone generators merely have a function of storing a series of tone waveform sample data corresponding to a tone waveform to be formed and repetitively outputting the thus-formed sample data in a successive manner, the waveform RAM 4 in the embodiment has a function as a buffer for temporarily storing PCM sound data when the sound data are to be transferred for sound reproduction or recording, in addition to the above-mentioned sample data storing/outputting function. A memory access control section 5 controls information transfer between the tone waveform ROM 3 and RAM 4 and various other components.

The digital sound generating system also includes an address calculating section 6, an interpolating section 7, a main calculating section 8, a filtering calculating section 9, a mixer 10 and a digital-to-analog (D/A) converter 11, and an analog-to-digital (A/D) converter 12. Of these, the components 6 to 11 are used in the embodiment for recording/reproduction of PCM sound data although they are the same as those included in conventional PCM tone generators. Further, in the present embodiment, sampling clock pulses are generated by a clock generator (not shown) at a predetermined frequency (e.g., 44.1 kHz), in response to which are conducted arithmetic operations using sample data of a tone waveform or continuous waveform of a vocal sound or the like or transfer of the sample data. Also, the D/A converter 11 and A/D converter 12 perform their D/A and A/D conversions in synchronism with the sampling clock pulses.

Exemplary operation of the present embodiment will be described hereinafter.

First, a description will be made about exemplary operation of the various components in the digital sound generating system. When tone generation is to be executed in the embodiment, the CPU gives a tone forming instruction to the tone generator control section 2 via the CPU interface 1, in response to which the control section 2 supplies the address calculating section 6 with frequency information (real number data) corresponding to a frequency at which tones are to be generated. In response to each sampling clock pulse generated by the clock generator, the address calculating section 6 adds a value of the frequency information to a current accumulated value, so as to form address data that increments at a rate corresponding to the tone frequency. In the formation of the address data, control is performed for a so-called "loop" reproduction as will be described later. Each address data created in this manner is given via the memory access control section 5 to the waveform ROM 3 or waveform RAM 4.

Figure 2:
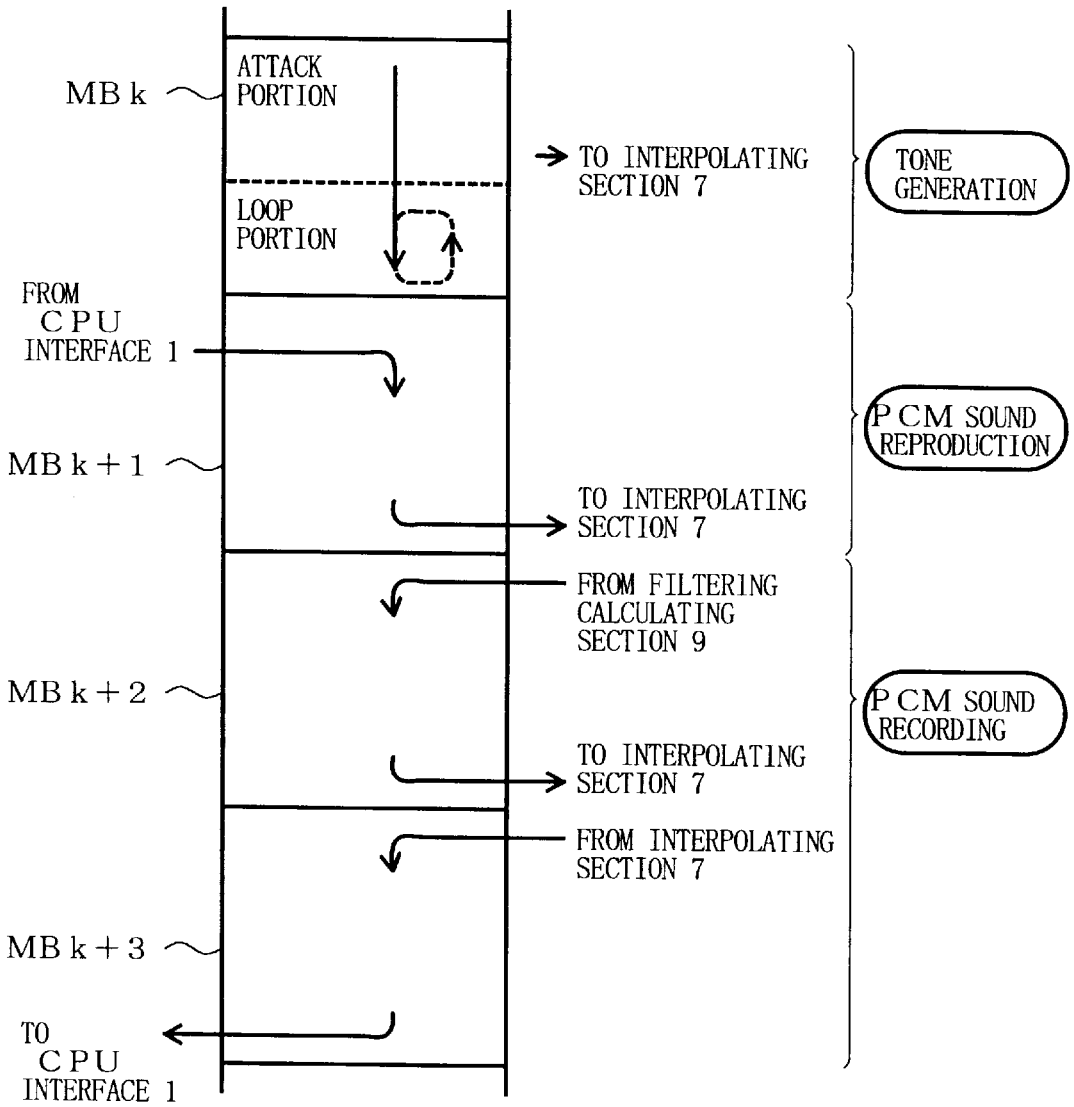
FIG. 2 is a diagram showing exemplary stored contents in a waveform RAM of FIG. 1.

FIG. 2 is a diagram showing exemplary stored contents in the waveform RAM 4. As shown, the waveform RAM 4 is divided into a plurality of memory blocks, in which are stored tone waveform sample data and other data. In the illustrated example of FIG. 2, tone waveform sample data are stored in one of the memory blocks $MB_k$, and the tone waveform may be considered here as a mere repetition of generally identical waveform portions except for its attack portion that is rich in variations. Thus, in memory block $MB_k$, there are stored tone waveform sample data corresponding to the attack portion of the tone waveform and tone waveform sample data corresponding to a loop portion of the waveform following the attack portion—the tone waveform sample data corresponding to the loop portion may be stored only for one period. In generating a tone, the tone waveform sample data corresponding to the attack portion are first read out from memory block $MB_k$, followed by the tone waveform sample data corresponding to the loop portion. In the address calculating section 6, the above-mentioned control is performed to effect such a loop reproduction.

Then, each time the sampling clock pulse is generated, the interpolating section 7 executes a process to convolute a series of interpolation coefficients, corresponding to decimal portions of the address data, into a predetermined number of the tone waveform data read out from the waveform RAM 4, so as to output tone waveform resample data corresponding to the address data. As previously noted, the address data increments at a rate corresponding to the tone frequency. Therefore, the interpolating section 7 provides tone waveform resample data of a tone waveform which is obtained by contracting or extending, in the time-axis direction, the waveform represented by the original tone waveform sample data and which corresponds to the desired tone frequency.

The main calculating section 8 executes processes to impart an envelope, corresponding to a desired tone color, to the tone waveform resample data sequentially output from the interpolating section 7 and to apply modulation, such as tremolo, to the data. The filtering calculating section 9 executes a filtering process, for tone color adjustment and effect impartment, on the tone waveform resample data output from the main calculating section 8.

Various processes by the address calculating section 6, interpolating section 7, main calculating section 8 and filtering calculating section 9 are controlled on a time-divisional basis. Namely, these sections 6, 7, 8 and 9 simultaneously execute arithmetic operations for generating plural sorts of tones, using a plurality of channels divided from each sampling period that is a time interval at which the tone waveform resample data is generated.

Every sampling period, the mixer 10 adds together the respective tone waveform resample data of the individual channels. In response to each sampling clock pulse, the D/A converter 11 converts output data of the mixer 10 into analog representation and supplies it to an output device such as a speaker.

The foregoing are various functions of the components corresponding to tone generating process.

This system can execute reproduction and recording of PCM sound data in addition to the above-mentioned tone generating process. In reproduction or recording of PCM sound data, the PCM sound data are transferred, via the digital sound generating system, from the large-capacity storage device of the system to the outside of the system or from the outside to the large-capacity storage device. In the digital sound generating system, various processes are performed for recording and reproduction of PCM sound data as well as for the transfer of the data.

The above-mentioned tone generating process is executed on the time-divisional basis using the channels, and the transfer of the PCM sound data for reproduction or recording is also conducted using these channels. Via the CPU interface 1, the CPU gives the tone generator control section 2 an instruction as to which one of the tone generating process and reproduction and recording of the PCM sound data is to be executed in the individual channels. Each of the above-mentioned sections performs the processes assigned to the individual channels. For example, the address calculating section 6 forms address data necessary for the concurrent processes under the time-divisional control; specifically, the address calculating section 6 forms address data for reading out tone waveform sample data necessary for tone generation in one of the channels, forms address data for reading out PCM sound data necessary for formation of sound resample data in another channel, and so forth. The other sections operate generally in the same manner.

In reproduction of the PCM sound data, the waveform RAM 4 in the digital sound generating system is used as a buffer when the PCM sound data are transferred from the large-capacity storage device to the outside via the digital sound generating system. In the illustrated example of FIG. 2, memory block $MB_{k+1}$ is used as a FIFO memory for accumulating the PCM sound data to be supplied to the outside. Detailed operation of memory block $MB_{k+1}$ as the FIFO memory is shown by way of example in FIG. 3.

Figures 3A, 3B, 3C, 3D:
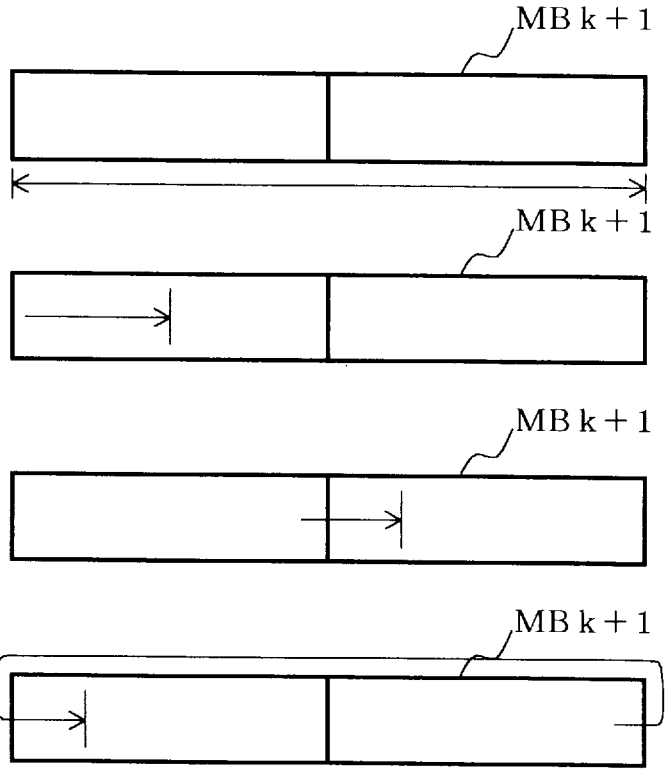
FIGS. 3A to 3D are diagrams showing an exemplary manner in which PCM sound data are transferred in the embodiment.

Once the reproduction of the PCM sound data is initiated, a sufficient quantity of the PCM sound data to fill memory block $MB_{k+1}$ are read out from the large-capacity storage device and introduced into the digital sound generating system by way of the CPU interface 1 to be accumulated in memory block $MB_{k+1}$ as shown in FIG. 3A. The accumulated PCM sound data are sequentially read out from memory block $MB_{k+1}$ on the first-in-first-out basis (i.e., rightward from the one located at the left end in FIG. 3B) and passed to the interpolating section 7. As the PCM sound data are read out from memory block $MB_{k+1}$, a corresponding vacant area is left in block $MB_{k+1}$.

Once the former half of memory block $MB_{k+1}$ has become vacant as shown in FIG. 3C, a request that succeeding PCM sound data be further supplied to the block is sent from the memory access control section 5 to the CPU via the CPU interface 1. In response to the request, the succeeding PCM sound data corresponding to one half of the storage capacity of memory block $MB_{k+1}$ are read out from the large-capacity storage device and supplied via the CPU interface 1 and memory access control section 5 to the waveform RAM 4, so that the vacant area in the former half of memory block $MB_{k+1}$ is replenished with the supplied data.

After the last PCM sound data has been read out from memory block $MB_{k+1}$, control is reverted to the head of block $MB_{k+1}$ so as to start reading out the above-mentioned succeeding PCM sound data as shown in FIG. 3D. Then, a request that further succeeding PCM sound data be supplied to the block is sent to the CPU, so that the currently-vacant latter half of memory block $MB_{k+1}$ is replenished with the further succeeding PCM sound data data. Thereafter, the above-mentioned operations are repeated such that the PCM sound data data are sequentially output from memory block $MB_{k+1}$ to the interpolating section 7 and PCM sound data are supplementally supplied to each vacant area left in block $MB_{k+1}$.

The above-mentioned address data to be used for reading or writing the PCM sound data are formed by the address calculating section 6 and sent to the waveform RAM 4 via the memory access control section 5. For the above-mentioned tone generating process, address data are formed which increment at a rate proportional to a desired tone frequency. For reproduction of the PCM sound data, frequency information is set on the basis of a sampling frequency at which the PCM sound data were originally sampled and address data are then made on the basis of the thus-set frequency information.

That is, in a case where the sampling frequency of the PCM sound data is 11.025 kHz, sounds having a frequency four times as high as that of the original sounds will be reproduced if the reproduction is executed in synchronism with the sampling clock pulses of 44.1 kHz used in the digital sound generating system. For this reason, in order to reproduce a sound of the same pitch as that of an original sound, frequency information for lowering the frequency by a factor of four is given to the address calculating section 6, so that the section 6 forms address data by cumulatively adding the frequency information and supplies the formed address data to the waveform RAM 4. As a result, the PCM sound data are read out from the waveform RAM 4 and then supplied to the interpolating section 7. As in the tone generating process, the interpolating section 7 convolutes a series of interpolation coefficients, corresponding to decimal portions of the address data, into a predetermined number of the PCM sound data read out from the waveform RAM 4, so as to output sound resample data corresponding to the address data. In this way, sound resample data (continuous waveform resample data) are obtained which represent a sound of the same frequency as when the sound was sampled.

Of course, because in the embodiment the frequency at which the PCM sound data is reproduced as a sound is adjustable depending on the frequency information to be given to the address calculating section 6, the sound data may be reproduced either at the same frequency as used for sampling the original sound (original sampling frequency) or the like or in a different frequency from the original sampling frequency. Alternatively, same PCM sound data corresponding to an identical waveform may be accumulated in a plurality of memory blocks so that these data are read out from the memory blocks on the basis of respective unique frequency information, so as to simultaneously reproduce sounds having different frequencies even though they are of the identical waveform.

Each sound resample data output from the interpolating section 7 is directly passed through the main calculating section 8 to the filtering calculating section 9, without being imparted an envelope or the like or after having been imparted a desired effect. The filtering calculating section 9 performs a filtering process on the sound resample data to remove therefrom high-frequency components exceeding the half of the sampling frequency of the D/A converter 11, to thereby prevent unwanted aliasing noise. Namely, in reproducing the PCM sound data, the filtering calculating section 9 performs the function of the analog filter 25 shown in FIG. 5.

If the analog filter is used to prevent aliasing noise, the analog filter itself needs to be of large scale and hence becomes costly as previously mentioned in connection with the conventional technique. However, in the present embodiment, such aliasing noise can be sufficiently obviated through digital processing.

Figure 4:
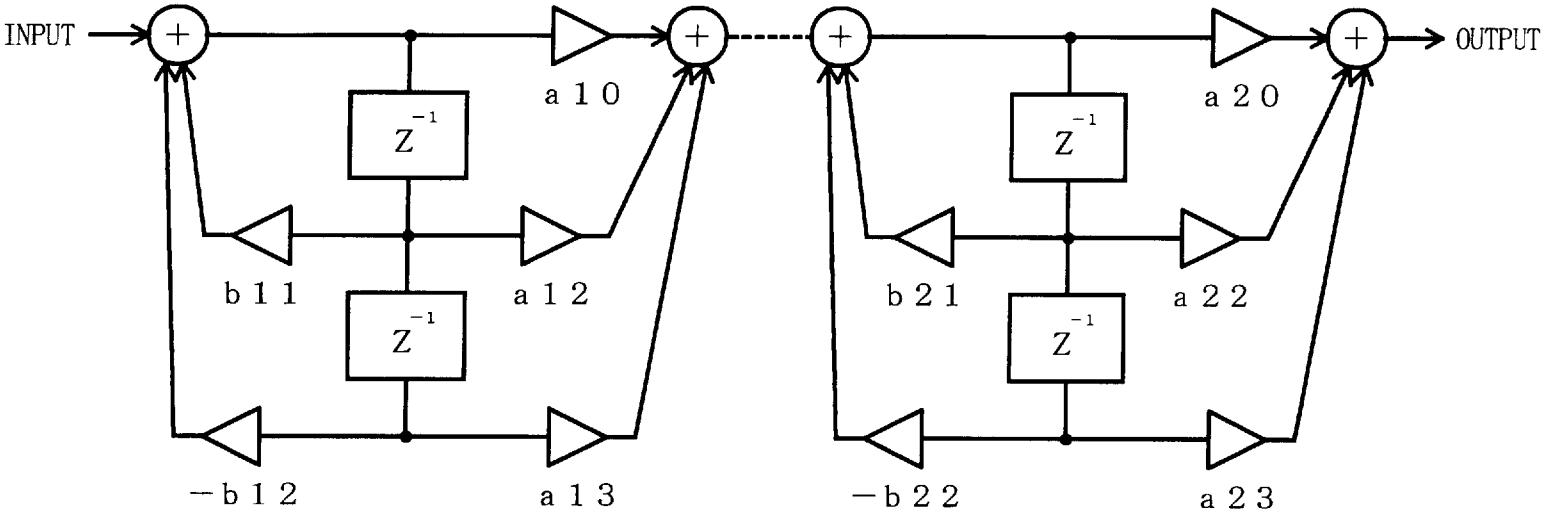
FIG. 4 is a diagram showing arithmetic operations performed by a filtering calculating section in the embodiment.

FIG. 4 illustrates an example of the filtering process for obviating aliasing noise. As shown, a plurality of second-order low-pass filters are cascaded to provide a filter having a desired quality factor (Q) and cut-off frequency, which can effectively eliminate the aliasing noise. Note that in the tone generating process, a tone-color-adjusting filtering process is performed on the tone waveform resample data by use of only the first-stage low-pass filter.

The filtering process may be performed either by use of the low-pass filter comprised of a digital circuit as shown in FIG. 4, or through arithmetic operations by a digital signal processor (DSP) or the like. Because the latter case involves a relatively great amount of calculation corresponding to the cascaded low-pass filters, the overall filtering arithmetic operations are executed under time-divisional control using a plurality of channels such that the arithmetic operations corresponding to the first-stage low-pass filter are conducted in the first channel, the arithmetic operations corresponding to the second-stage low-pass filter are conducted in the second channel using the calculated result of the first channel, and so forth. Any suitable number of the cascaded low-pass filters may be used depending on required frequency characteristics, calculating speed, etc. Further, the filtering calculating section 9 may execute a filtering process for imparting a particular effect, in addition to the filtering process for obviating the aliasing noise.

The sound resample data output from the filtering calculating section 9 are mixed with other tone waveform resample data via the mixer 10. Each output data of the mixer 10 is converted via the D/A converter 11 into an analog signal, which is then supplied to the speaker or the like.

In cases where a PCM sound reproducing device and tone generator device are provided separately from each other as in the conventional technique, D/A converters need to be provided on the respective output sections of the two devices and also an analog mixer is required for adding together analog signals output from the two devices so as to supply the addition result to the speaker or the like. However, according to the described embodiment, the vocal sound or the like and the tone are added together via the mixer 10 provided in the digital sound generating system and the addition result is output after having been converted into analog representation; with such an arrangement, it is not necessary to provide the D/A converter in duplicate and no analog mixer is required.

Next, a description will be made about recording of PCM sound data. First, in response to each sampling clock pulse of the predetermined frequency (e.g., 44.1 kHz), the A/D converter 12 converts into PCM sound data an analog signal of a continuous waveform of a vocal sound or the like.

In the conventional PCM sound recording device of FIG. 6, the sampling frequency of the A/D converter 34 can be varied so that PCM sound data corresponding to a desired sampling frequency are formed at the time of the A/D conversion by the converter 34. Further, it has been common practice in the art to provide an analog filter at a stage preceding the A/D converter so as to prevent occurrence of aliasing noise; however, with the arrangement of FIG. 6, the analog filter 35 needs to be of variable cut-off frequency because the A/D conversion is performed using various sampling frequencies.

In contrast, in the present embodiment, the A/D conversion itself is conducted at a fixed sampling frequency as described earlier, and each resultant PCM sound data of the fixed sampling frequency is converted via the address calculating section 6 and interpolating section 7 into sound resample data corresponding to a desired sampling frequency (as will be later described). This sound resample data is recorded. Further, because the present embodiment conducts the A/D conversion using just one sampling frequency, it is sufficient that an analog filter having a cut-off frequency that is one half of the sampling frequency is provided at a stage preceding the A/D converter 12. Note that illustration of this analog filter is omitted in FIG. 1.

Each PCM sound data output from the A/D converter 12 is passed to the filtering calculating section 9 to undergo the filtering arithmetic operations as shown in FIG. 4, so that high-frequency components above a predetermined cut-off frequency are eliminated from the data. The elimination of the high-frequency components is intended for preventing aliasing noise from occurring due to a subsequent sampling frequency conversion. Thus, various coefficients to be used for the filtering arithmetic operations (e.g., $a_{10}$, $a_{12}$, . . . , $-b_{22}$) are determined and set by the tone control section 22 in such a manner that a cut-off frequency is obtained which is equal to one half of the sampling data of ultimate sound resample data.

Further, each PCM sound data output from the filtering calculating section 9 is supplied to the waveform RAM 4 via the memory access control section 5. As shown by way of example in FIG. 2, the PCM sound data are sequentially accumulated, for example, in memory block $MB_{k+2}$ of the waveform RAM 4. Address data designating respective locations at which the PCM sound data should be written are sequentially formed by the address calculating section 6 and supplied to the waveform RAM 4 via the memory access control section 5.

The tone generator control section 2 determines a ratio, of the sampling frequency of the desired sound resample data, to the sampling frequency of the A/D converter 12, and frequency information indicative of the determined ratio is supplied to the address calculating section 6. The address calculating section 6, in turn, accumulates this frequency in response to the sampling clock pulse and outputs resultant address data, using one of the channels other than the one through which the write address data are output.

The memory access control section 5 monitors the address data in such a way that each time the address data increments by one, an oldest one of the PCM sound data stored in memory block $MB_{k+2}$ is read out to be supplied to the interpolating section 7. The interpolating section 7 convolutes a series of interpolation coefficients, corresponding to decimal portions of the address data, into a predetermined number of previously received PCM sound data, so as to provide the memory access control section 5 sound resample data corresponding to the address data.

The memory access control section 5 sequentially accumulates the thus-supplied sound resample data into, for example, memory block $MB_{k+3}$ of the waveform RAM 4 (see FIG. 2). Once a predetermined quantity of the sound resample data have been accumulated in memory block $MB_{k+3}$, the memory access control section 5 sends the CPU a request via the CPU interface 1 that the accumulated sound resample data should be stored into the large-capacity storage device. When this request is accepted, the memory access control section 5 reads out the accumulated sound resample data from memory block $MB_{k+3}$ to output the data to the large-capacity storage device for storage therein. In the above-mentioned manner, each time a predetermined quantity of the sound resample data have been accumulated in memory block $MB_{k+3}$, these accumulated data are read out for storage in the large-capacity storage device.

The present invention should not be understood as limited to the described embodiment, and various modifications of the invention are possible as follows.

(1) While the embodiment has been described as a digital sound generating system having functions to reproduce and record PCM sound data, the present invention may be practiced as a digital sound generating system having only the PCM sound data reproducing function.

(2) In the above-described embodiment, the address data for reading out the PCM sound data is formed by accumulating frequency information that is a ratio, of the desired sampling frequency, to the sampling frequency of the A/D converter. However, the following alternative may be employed if the ratio is below a value "1". Namely, in this alternative, each time the sampling clock pulse is generated, the address calculating section 6 accumulates "1" so that PCM sound data are transferred from the waveform RAM 4 to the interpolating section 7 once the accumulated value exceeds a preset value corresponding to the desired sampling frequency. At that time, a preset value is subtracted from the accumulated value, and the subtraction result is sent to the interpolating section 7, which in turn convolutes a series of interpolation coefficients, determined on the basis of the accumulated value after the subtraction, into a predetermined number of previously received PCM sound data.

(3) During recording of PCM sound data, PCM sound data may be simultaneously reproduced or recorded so that the data are recorded in a mixed (overdubbed) manner. For example, although not specifically described in connection with the preferred embodiment, such overdubbing can be effected by performing recording or reproduction simultaneously with the recording in the arrangement of FIG. 1, selecting a result of adding together output data from the mixer 10 and output data from the A/D converter 12 and passing the selected data to the filtering calculating section 9.

The present invention arranged in the above-described manner affords the following benefits.

With the arrangement that data transfer for reproduction or recording of a continuous waveform, of a vocal sound or the like, involving a relatively long reproduction or sounding time, the tone generation and reproduction or recording of a continuous waveform can be executed without increasing the hardware scale and overall costs of the digital sound generating system. Further, because in the present invention the frequency of the continuous waveform resample data can be controlled by just changing the rate of address rate formed by the address calculating section, the same existing tone generator hardware can be used to reproduce a prerecorded continuous waveform at various frequencies, and reproduce continuous waveform sample data sampled at various frequencies or record continuous waveform sample data at various frequencies. Furthermore, in the present invention, the filter for controlling tone color during the tone generating process can be also used in the filtering process to prevent occurrence of aliasing noise during reproduction or recording of continuous waveform sample data, so that good-quality reproduction or recording of the continuous waveform sample data is achieved.

What is claimed is:

1. A digital sound generating system comprising:

storage means including first and second storage areas for storing waveform data, at least said second storage area comprising a readable and writable memory;

addressing means for making address data for writing or reading out waveform data into or from said storage means;

digital filter means for filtering the waveform data read out from said storage means;

first control means for controlling said addressing means to read out first waveform data stored in said first storage area at a rate corresponding to a desired tone pitch, so as to permit reproduction of a sound corresponding to said first waveform data;

supply means for supplying second waveform data; and second control means for controlling said addressing means to write specific ones of said second waveform data from said supply means into a first portion of said second storage area, then sequentially read out said specific ones of said second waveform data from said first portion of said second storage area and also write other ones of said second waveform data into a second portion of said second storage area, and then sequentially read out said other ones of said second waveform data, so as to allow sounds corresponding to said second waveform data to be reproduced in a successive manner.

2. A digital sound generating system as claimed in claim 1 which further comprises interpolating means for interpolating between the waveform data read out from said storage means, output data from said interpolating means being supplied to said digital filter means.

3. A digital sound generating system as claimed in claim 1 which further comprises digital-to-analog converter means for converting output digital waveform data from said digital filter means into an analog signal.

4. A digital sound generating system as claimed in claim 1 wherein said second waveform data corresponds to a sound involving a relatively long reproduction time.

5. A digital sound generating system as claimed in claim 1 wherein said second waveform data contains an optional sound sampled from outside of said system.

6. A digital sound generating system as claimed in claim 1 wherein said supply means comprises a large-capacity storage device such as a hard disk.

7. A digital sound generating system as claimed in claim 1 which further comprises means for variably controlling a filtering characteristic of said digital filter means depending on the waveform data to be filtered.

8. A digital sound generating system as claimed in claim 1 wherein said first and second control means share said addressing means on a time-divisional basis for said first and second waveform data.

9. A digital sound generating system as claimed in claim 1 which further comprises analog-to-digital converter means for converting into digital data an analog sound signal sampled from outside of said system, and wherein the digital data output from said analog-to-digital converter means is processed by said digital filter means and then temporarily stored into said storage means, the digital data being then sequentially read out from said storage means to be output from said system.

10. A digital sound generating system comprising:

storage means including first and second storage areas for storing waveform data, at least said second storage area comprising a readable and writable memory;

addressing means for making address data for writing or reading out waveform data into or from said storage means;

digital filter means;

first control means for controlling said addressing means to read out first waveform data stored in said first storage area at a rate corresponding to a desired tone pitch and supplying the read-out first waveform data to said digital filter means, so as to allow reproduction of a sound corresponding to said first waveform data;

analog-to-digital converter means for converting into digital data an analog sound signal sampled from outside of said system and supplying the digital data to said digital filter means; and second control means for controlling said addressing means to sequentially write the digital data from said digital filter means into said second storage area for temporary storage therein and then sequentially read out the digital data from said second storage area, said second control means outputting the digital data, read out from said second storage area, from said system.

11. A digital sound generating system as claimed in claim 10 wherein a large-capacity storage device such as a hard disk is connected to an output terminal section of said system and the data read out from said second storage area via said second control means is stored into said large-capacity storage device.

12. A digital sound generating system as claimed in claim 10 which further comprises interpolating means for interpolating between waveform data, and wherein when said first waveform data are read out from said storage means via said first control means, said interpolating means interpolates between said first waveform data so as to supply the interpolated first waveform data to said digital filter means.

13. A digital sound generating system as claimed in claim 12 wherein the data sequentially read out from said second storage area via said second control means are processed by said interpolating means before being output from said system.

14. A digital sound generating system as claimed in claim 13 wherein said first and second control means share said addressing means, digital filter means and interpolating means on a time-divisional basis.

15. A digital sound generating system as claimed in claim 14 which further comprises means for mixing said first waveform data output from said digital filter means with the digital data output from said analog-to-digital converter means and supplying the mixed data to said digital filter means.

16. A digital sound generating system comprising:

storage means including first and second storage areas for storing waveform data, at least said second storage area comprising a readable and writable memory;

addressing means for making address data for writing or reading out waveform data into or from said storage means;

digital filter means;

first control means for controlling said addressing means to read out first waveform data stored in said first storage area at a rate corresponding to a desired tone pitch and supplying the read-out first waveform data to said digital filter means, so as to allow reproduction of a sound corresponding to said first waveform data;

supply means for supplying second waveform data;

second control means for controlling said addressing means to write specific ones of said second waveform data from said supply means into a first portion of said second storage area, then sequentially read out said specific ones of said second waveform data from said first portion of said second storage area and also write other ones of said second waveform data into a second portion of said second storage area, and then sequentially read out said other ones of said second waveform data, so as to allow sounds corresponding to said second waveform data to be reproduced in a successive manner;

analog-to-digital converter means for converting into digital data an analog sound signal sampled from outside of said system and supplying the digital data to said digital filter means; and third control means for controlling said addressing means to sequentially write the digital data from said digital filter means into said second storage for temporary storage therein and then sequentially read out the data from said second storage area, said third control means outputting the digital data, read out from said second storage area, from said system.

17. A digital sound generating system for outputting an analog signal representing a tone waveform and an analog signal representing a continuous waveform having a long reproduction time, said system comprising:

a memory;

an address calculator, responsive to a tone generating instruction, for sequentially outputting tone waveform address data changing at a rate corresponding to a frequency of a tone waveform to be formed, and, responsive to a continuous waveform reproducing instruction, for sequentially outputting continuous waveform address data changing at a rate corresponding to a sampling frequency of a continuous waveform to be reproduced;

an interpolator which, when the tone generating instruction is given and tone waveform sample data are read out from said memory, performing an interpolation process on a predetermined number of read-out tone waveform sample data so as to output tone waveform resample data corresponding to said tone waveform address data, and when the continuous waveform reproducing instruction is given and continuous waveform sample data are read out from said memory, performing an interpolation process on a predetermined number of read-out continuous waveform sample data so as to output continuous waveform resample data corresponding to said continuous waveform address data;

a memory access control for, when the tone generating instruction is given, sequentially reading out the tone waveform sample data from said memory on the basis of the tone waveform address data, and when the continuous waveform reproducing instruction is given, loading continuous waveform sample data representing a continuous waveform from outside into said system so as to store the continuous waveform sample data into said memory depending on a state of vacancy in said memory and then sequentially reading out the continuous waveform sample data from said memory on the basis of the continuous waveform address data;

a filtering calculator for, using an adjustable filter coefficient, performing a tone-color adjusting filtering process on the tone waveform resample data and performing a high-frequency-component removing process on the continuous waveform address data to prevent aliasing noise; and a digital-to-analog converter which converts, into an analog signal, the tone waveform resample data or continuous waveform resample data having undergone the filtering process.

18. A digital sound generating system for outputting an analog signal representing a tone waveform and an analog signal representing a continuous waveform involving a relatively long reproduction time, said system comprising:

a memory;

an analog-to-digital converter which, in response to a sampling clock pulse of fixed frequency, samples and codes the analog signal representing a continuous waveform so as to output continuous waveform sample data;

an address calculator, responsive to a tone generating instruction, for sequentially outputting tone waveform address data changing at a rate corresponding to a frequency of a tone waveform to be formed, and, responsive to a continuous waveform reproducing or recording instruction, for sequentially outputting continuous waveform address data changing at a rate corresponding to a sampling frequency of a continuous waveform to be reproduced or recorded;

an interpolator which, when the tone generating instruction is given and tone waveform sample data are read out from said memory, performs an interpolation process on a predetermined number of read-out tone waveform sample data so as to output tone waveform resample data corresponding to said tone waveform address data, and when the continuous waveform reproducing or recording instruction is given and continuous waveform sample data are read out from said memory, performs an interpolation process on a predetermined number of read-out continuous waveform sample data so as to output continuous waveform resample data corresponding to said continuous waveform address data;

a memory access control which operates in such a manner that: when the tone generating instruction is given, said memory access control sequentially reads out the tone waveform sample data from said memory on the basis of the tone waveform address data; when the continuous waveform reproducing instruction is given, said memory access control loads continuous waveform sample data representing a continuous waveform from outside into said system so as to store the continuous waveform sample data into said memory depending on a state of vacancy in said memory and then sequentially reads out the continuous waveform sample data from said memory on the basis of the continuous waveform address data; and when the continuous waveform recording instruction is given, said memory access control stores into said memory the continuous waveform sample data supplied via said analog-to-digital converter and reads out the continuous waveform sample data from said memory on the basis of the continuous waveform address data to supply the read-out continuous waveform sample data to said interpolator, said memory access control also storing into said memory the continuous waveform resample data output from said interpolator and outputting the continuous waveform resample data from said system each time a predetermined quantity of the continuous waveform resample data have been accumulated in said memory;

a filtering calculator which, using an adjustable filter coefficient, performs a tone-color adjusting filtering process on the tone waveform resample data, and performs a high-frequency-component removing process on the continuous waveform resample data supplied from said interpolator and the continuous waveform sample data supplied from said analog-to-digital converter to said memory access control so as to prevent aliasing noise therefrom; and a digital-to-analog converter which converts, into an analog signal, the tone waveform resample data or continuous waveform resample data having undergone the process by said filtering calculator.

19. A digital sound generating system comprising:

a storage device including first and second storage areas for storing waveform data, at least said second storage area comprising a readable and writable memory;

an addressing section which makes address data for writing or reading out waveform data into or from said storage device;

a digital filter which filters the waveform data read out from said storage device;

a first control which controls said addressing section to read out first waveform data stored in said first storage area at a rate corresponding to a desired tone pitch, so as to permit reproduction of a sound corresponding to said first waveform data;

a supply section which supplies second waveform data; and a second control which controls said addressing section to write specific ones of said second waveform data from said supply section into a first portion of said second storage area, then sequentially read out said specific ones of said second waveform data from said first portion of said second storage area and also write other ones of said second waveform data into a second portion of said second storage area, and then sequentially read out said other ones of said second waveform data, so as to allow sounds corresponding to said second waveform data to be reproduced in a successive manner.

20. A digital sound generating system comprising:

a storage device including first and second storage areas for storing waveform data, at least said second storage area comprising a readable and writable memory;

an addressing section which makes address data for writing or reading out waveform data into or from said storage device, a digital filter;

a first control which controls said addressing section to read out first waveform data stored in said first storage area at a rate corresponding to a desired tone pitch and supplying the read-out first waveform data to said digital filter, so as to allow reproduction of a sound corresponding to said first waveform data;

an analog-to-digital converter which converts into digital data an analog sound signal sampled from outside of said system and supplying the digital data to said digital filter; and a second control which controls said addressing section to sequentially write the digital data from said digital filter into said second storage area for temporary storage therein and then sequentially read out the digital data from said second storage area, said second control outputting the digital data, read out from said second storage area, from said system.

21. A digital sound generating system comprising:

a storage device including first and second storage areas for storing waveform data, at least said second storage area comprising a readable and writable memory;

an addressing section which makes address data for writing or reading out waveform data into or from said storage device;

a digital filter;

a first control which controls said addressing section to read out first waveform data stored in said first storage area at a rate corresponding to a desired tone pitch and supplying the read-out first waveform data to said digital filter, so as to allow reproduction of a sound corresponding to said first waveform data;

a supply section which supplies second waveform data;

a second control which controls said addressing section to write specific ones of said second waveform data from said supply section into a first portion of said second storage area, then sequentially read out said specific ones of said second waveform data from said first portion of said second storage area and also write other ones of said second waveform data into a second portion of said second storage area, and then sequentially read out said other ones of said second waveform data, so as to allow sounds corresponding to said second waveform data to be reproduced in a successive manner;

an analog-to-digital converter which converts into digital data an analog sound signal sampled from outside of said system and supplying the digital data to said digital filter; and a third control which controls said addressing section to sequentially write the digital data from said digital filter into said second storage area for temporary storage therein and then sequentially read out the data from said second storage area, said third control outputting the digital data, read out from said second storage area, from said system.

22. A method of generating a sound signal by use of a system which includes: a storage device including first and second storage areas for storing waveform data, at least said second storage area comprising a readable and writable memory; an addressing section which makes address data for writing or reading out waveform data into or from said storage device; and a digital filter which filters the waveform data read out from said storage device, said method comprising the steps of:

controlling said addressing section to read out first waveform data stored in said first storage area at a rate corresponding to a desired tone pitch, so as to permit reproduction of a sound corresponding to said first waveform data;

supplying second waveform data to said second storage area;

controlling said addressing section to write specific ones of said second waveform data into a first portion of said second storage area, then sequentially read out said specific ones of said second waveform data from said first portion of said second storage area and also write other ones of said second waveform data into a second portion of said second storage area, and then sequentially read out said other ones of said second waveform data, so as to allow sound signals corresponding to said second waveform data to be reproduced in a successive manner.

23. A method of generating a sound signal by use of a system which includes: a storage device including first and second storage areas for storing waveform data, at least said second storage area comprising a readable and writable memory; an addressing section which makes address data for writing or reading out waveform data into or from said storage device; a digital filter; and an analog-to-digital converter which converts into digital data an analog sound signal sampled from outside of said system and supplying the digital data to said digital filter, said method comprising the steps of:

controlling said addressing section to read out first waveform data stored in said first storage area at a rate corresponding to a desired tone pitch and supplying the readout first waveform data to said digital filter, so as to allow reproduction of a sound corresponding to said first waveform data; and controlling said addressing section to sequentially write the digital data from said digital filter into said second storage area for temporary storage therein and then sequentially read out the digital data from said second storage area to output the read-out digital data.

24. A method of generating a sound signal by use of a system which includes: a storage device including first and second storage areas for storing waveform data, at least said second storage area comprising a readable and writable memory; an addressing section which makes address data for writing or reading out waveform data into or from said storage device; a digital filter; and an analog-to-digital converter which converts into digital data an analog sound signal sampled from outside of said system and supplying the digital data to said digital filter, said method comprising the steps of:

controlling said addressing section to read out first waveform data stored in said first storage area at a rate corresponding to a desired tone pitch and supplying the read out first waveform data to said digital filter, so as to allow reproduction of a sound corresponding to said first waveform data;

supplying second waveform data to said second storage area;

controlling said addressing section to write specific ones of said second waveform data into a first portion of said second storage area, then sequentially read out said specific ones of said second waveform data from said first portion of said second storage area and also write other ones of said second waveform data into a second portion of said second storage area, and then sequentially read out said other ones of said second waveform data, so as to allow sound signals corresponding to said second waveform data to be reproduced in a successive manner; and controlling said addressing section to sequentially write the digital data from said digital filter into said second storage area for temporary storage therein and then sequentially read out the data from said second storage area to output the read-out digital data.

25. A machine-readable recording medium containing a group of instructions to cause said machine to implement a method of generating a sound signal by use of a system which includes: a storage device including first and second storage areas for storing waveform data, at least said second storage area comprising a readable and writable memory; an addressing section which makes address data for writing or reading out waveform data into or from said storage device; and a digital filter which filters the waveform data read out from said storage device, said method comprising the steps of:

controlling said addressing section to read out first waveform data stored in said first storage area at a rate corresponding to a desired tone pitch, so as to permit reproduction of a sound corresponding to said first waveform data;

supplying second waveform data to said second storage area;

controlling said addressing section to write specific ones of said second waveform data into a first portion of said second storage area, then sequentially read out said specific ones of said second waveform data from said first portion of said second storage area and also write other ones of said second waveform data into a second portion of said second storage area, and then sequentially read out said other ones of said second waveform data, so as to allow sound signals corresponding to said second waveform data to be reproduced in a successive manner.

26. A machine-readable recording medium containing a group of instructions to cause said machine to implement a method of generating a sound signal by use of a system which includes: a storage device including first and second storage areas for storing waveform data, at least said second storage area comprising a readable and writable memory; an addressing section which makes address data for writing or reading out waveform data into or from said storage device; a digital filter; and an analog-to-digital converter which converts into digital data an analog sound signal sampled from outside of said system and supplying the digital data to said digital filter, said method comprising the steps of:

controlling said addressing section to read out first waveform data stored in said first storage area at a rate corresponding to a desired tone pitch and supplying the readout first waveform data to said digital filter, so as to allow reproduction of a sound corresponding to said first waveform data; and controlling said addressing section to sequentially write the digital data from said digital filter into said second storage area for temporary storage therein and then sequentially read out the digital data from said second storage area to output the read-out digital data.

27. A machine-readable recording medium containing a group of instructions to cause said machine to implement a method of generating a sound signal by use of a system which includes: a storage device including first and second storage areas for storing waveform data, at least said second storage area comprising a readable and writable memory; an addressing section which makes address data for writing or reading out waveform data into or from said storage device; a digital filter; and an analog-to-digital converter which converts into digital data an analog sound signal sampled from outside of said system and supplying the digital data to said digital filter, said method comprising the steps of:

controlling said addressing section to read out first waveform data stored in said first storage area at a rate corresponding to a desired tone pitch and supplying the read out first waveform data to said digital filter, so as to allow reproduction of a sound corresponding to said first waveform data;

supplying second waveform data to said second storage area;

controlling said addressing section to write specific ones of said second waveform data into a first portion of said second storage area, then sequentially read out said specific ones of said second waveform data from said first portion of said second storage area and also write other ones of said second waveform data into a second portion of said second storage area, and then sequentially read out said other ones of said second waveform data, so as to allow sound signals corresponding to said second waveform data to be reproduced in a successive manner; and controlling said addressing section to sequentially write the digital data from said digital filter into said second storage area for temporary storage therein and then sequentially read out the data from said second storage area to output the read-out digital data.

* * * * *